US011637357B2

(12) United States Patent
Carper et al.

(10) Patent No.: US 11,637,357 B2
(45) Date of Patent: Apr. 25, 2023

(54) WINDSHIELD EMBEDDED MULTIBAND GNSS TRANSPARENT ANTENNA WITH A MULTIBAND ELECTROMAGNETIC COUPLER

(71) Applicant: GM Global Technology Operations LLC, Detroit, MI (US)

(72) Inventors: Duane S. Carper, Davison, MI (US); Hyok Jae Song, Oak Park, CA (US); James H. Schaffner, Chatsworth, CA (US); Raymond Gary Acker, Royal Oak, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/410,393

(22) Filed: Aug. 24, 2021

(65) Prior Publication Data

US 2023/0068756 A1 Mar. 2, 2023

(51) Int. Cl.

| | |
|---|---|
| ***H01Q 5/378*** | (2015.01) |
| ***H01Q 1/12*** | (2006.01) |
| ***H01Q 1/40*** | (2006.01) |
| ***H01Q 9/04*** | (2006.01) |

(52) U.S. Cl.

CPC ..... *H01Q 1/1285* (2013.01); *H01Q 1/40* (2013.01); *H01Q 5/378* (2015.01); *H01Q 9/0428* (2013.01)

(58) Field of Classification Search

CPC ... H01Q 1/1271; H01Q 1/1285; H01Q 9/0428

See application file for complete search history.

(56) References Cited

U.S. PATENT DOCUMENTS

| | | | | |
|---|---|---|---|---|
| 10,490,877 | B2 | 11/2019 | Talty et al. | |
| 2012/0068896 | A1* | 3/2012 | White | H01Q 1/1271 343/713 |
| 2019/0348753 | A1 | 11/2019 | Song et al. | |

OTHER PUBLICATIONS

Yasan, et al., "Field Performance of a Novel Wideband Optically Transparent GNSS Antenna," 2019 IEEE International Symposium on Antennas and Propagation and USNC-URSI Radio Science Meeting, Atlanta, GA, USA, 2019, pp. 847-848.

* cited by examiner

*Primary Examiner* — Daniel Munoz
(74) *Attorney, Agent, or Firm* — Cantor Colburn LLP

(57) ABSTRACT

A windshield, vehicle and antenna assembly for the vehicle is disclosed. The antenna assembly includes an antenna and a signal coupler. The antenna is embedded within the windshield of the vehicle. The antenna is configured to receive signals over a first frequency band and a second frequency band separated from the first frequency band. The signal coupler electromagnetically couples to the antenna through the windshield.

20 Claims, 12 Drawing Sheets

| Name | Ang | Mag |
|---|---|---|
| m1 | -42.0000 | -1.9373 |
| m2 | -44.0000 | -3.0524 |

| Name | Ang | Mag |
|---|---|---|
| m1 | -24.0000 | 0.4595 |
| m2 | -17.0000 | -3.5467 |

| Name | Ang | Mag |
|---|---|---|
| m1 | -65.0000 | -0.0840 |
| m2 | -19.0000 | -4.2620 |

| Name | Ang | Mag |
|---|---|---|
| m1 | -28.0000 | 0.5737 |
| m2 | 32.0000 | -2.1843 |

WINDSHIELD EMBEDDED MULTIBAND GNSS TRANSPARENT ANTENNA WITH A MULTIBAND ELECTROMAGNETIC COUPLER

INTRODUCTION

The subject disclosure relates to an antenna embedded in a windshield and, in particular, to an antenna structure for communication within both of two separate radio frequency bands.

Vehicles generally include communication devices for receiving signals. With the growth in the number of different technologies that can be useful to the vehicle, the number of communication frequency bands has increased as well. Since an antenna is generally designed for a single frequency band, multiple antennas are needed when a plurality of separate frequency bands are desired. Thus, the number of antennas at the vehicle can quickly add up. Accordingly, it is desirable to provide an antenna system that is responsive to signals in more than one frequency band.

SUMMARY

In one exemplary embodiment, an antenna assembly for a vehicle is disclosed. The antenna assembly includes an antenna and a signal coupler. The antenna is configured to receive signals over a first frequency band and a second frequency band separated from the first frequency band, wherein the antenna is embedded within a windshield of the vehicle. The signal coupler electromagnetically couples to the antenna through the windshield.

In addition to one or more of the features described herein, the first frequency band is an L1 frequency band and the second frequency band is an L5 frequency band. In an embodiment, the antenna is in a shape of a rectangle with an interior region and a first stub and a second stub extending into the interior region, wherein the first stub and the second stub are configured for receiving a circularly polarized signal within both of the first band and the second band. The first stub extends into the interior region from a first side of the rectangle and the second stub passes through a gap in a second side of the rectangle adjacent the first side. The first stub includes a first plate disposed at an end of a first arm and the second stub includes a second plate having a first prong and a second prong parallel to the first prong, the first prong including an extension separated from the second prong by an extension gap. The signal coupler further includes a transmission line and a conductive slot layer disposed between the transmission line and the windshield, the conductive slot layer including a slot perpendicular to the transmission line. The antenna includes a first stub and a second stub and the second stub extends parallel to the transmission line and overlaps the transmission line at the slot.

In another exemplary embodiment, a windshield is disclosed. The windshield includes an antenna and a signal coupler. The antenna is configured to receive signals over a first frequency band and a second frequency band separated from the first frequency band, wherein the antenna is embedded within the windshield. The signal coupler electromagnetically couples to the antenna through the windshield.

In addition to one or more of the features described herein, the first frequency band is an L1 frequency band and the second frequency band is an L5 frequency band. In an embodiment, the antenna is in a shape of a rectangle with an interior region and a first stub and a second stub extending into the interior region, wherein the first stub and the second stub are configured for receiving a circularly polarized signal within both of the first band and the second band. The first stub extends into the interior region from a first side of the rectangle and the second stub passes through a gap in a second side of the rectangle adjacent the first side. The first stub includes a first plate disposed at an end of a first arm and the second stub includes a second plate having a first prong and a second prong parallel to the first prong, the first prong including an extension separated from the second prong by an extension gap. The signal coupler further includes a transmission line and a conductive slot layer disposed between the transmission line and the windshield, the conductive slot layer including a slot perpendicular to the transmission line. The antenna includes a first stub and a second stub and the second stub extends parallel to the transmission line and overlaps the transmission line at the slot.

In yet another exemplary embodiment, a vehicle is disclosed. The vehicle includes an antenna and a signal coupler. The antenna is configured to receive signals over a first frequency band and a second frequency band separated from the first frequency band, wherein the antenna is embedded within a windshield of the vehicle. The signal coupler electromagnetically couples to the antenna through the windshield.

In addition to one or more of the features described herein, the first frequency band is an L1 frequency band and the second frequency band is an L5 frequency band. In an embodiment, the antenna is in a shape of a rectangle with an interior region and a first stub and a second stub extending into the interior region, wherein the first stub and the second stub are configured for receiving a circularly polarized signal within both of the first band and the second band. The first stub extends into the interior region from a first side of the rectangle and the second stub passes through a gap in a second side of the rectangle adjacent the first side. The first stub includes a first plate disposed at an end of a first arm and the second stub includes a second plate having a first prong and a second prong parallel to the first prong, the first prong including an extension separated from the second prong by an extension gap. The signal coupler further includes a transmission line and a conductive slot layer disposed between the transmission line and the windshield, the conductive slot layer including a slot perpendicular to the transmission line, wherein the antenna includes a first stub and a second stub that extends parallel to the transmission line and overlaps the transmission line at the slot.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
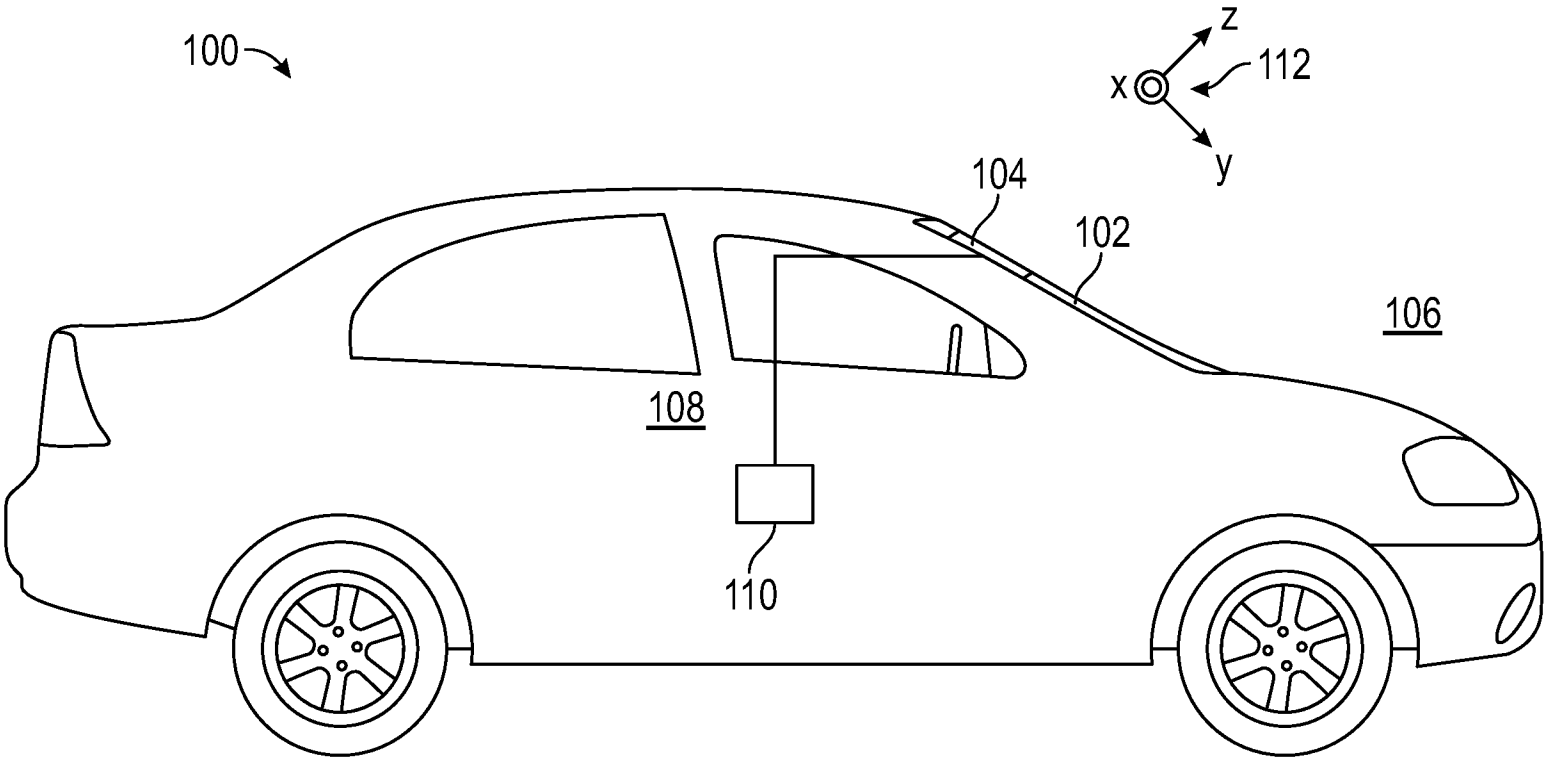
FIG. 1 shows a vehicle in an illustrative embodiment.

The following description is merely exemplary in nature and is not intended to limit the present disclosure, its application or uses. It should be understood that throughout the drawings, corresponding reference numerals indicate like or corresponding parts and features.

In accordance with an exemplary embodiment, FIG. 1 shows a vehicle 100. The vehicle 100 includes a windshield 102 having an antenna assembly 104 embedded therein for communication purposes. The windshield 102 separates the space around the vehicle 100 into an outer region 106 outside of the vehicle (i.e., in front of the windshield 102) and an inner region 108 inside of the vehicle (i.e., behind the windshield). A coordinate system 112 is shown for the antenna assembly 104. The x-axis and y-axis define a plane of the antenna assembly 104. The z-axis is directed out of the antenna assembly 104 into the outer region 106.

The antenna assembly 104 is coupled to a communication device 110, such as a Global Positioning Satellite (GPS) or a Global Navigation Satellite System (GNSS) receiver, for example. In various embodiments, the antenna assembly 104 is capable of communicating over both of a first frequency band and a second frequency band separated from the first band. In various embodiments, the first frequency band is an L1 frequency band having a central (carrier) frequency of 1575.42 MegaHertz (MHz) and the second band is an L5 frequency band having a central frequency of 1176.45 MHz. The antenna assembly 104 has a reduced responsiveness to signals in a frequency range between the L1 frequency band and the L5 frequency band.

Figure 2:
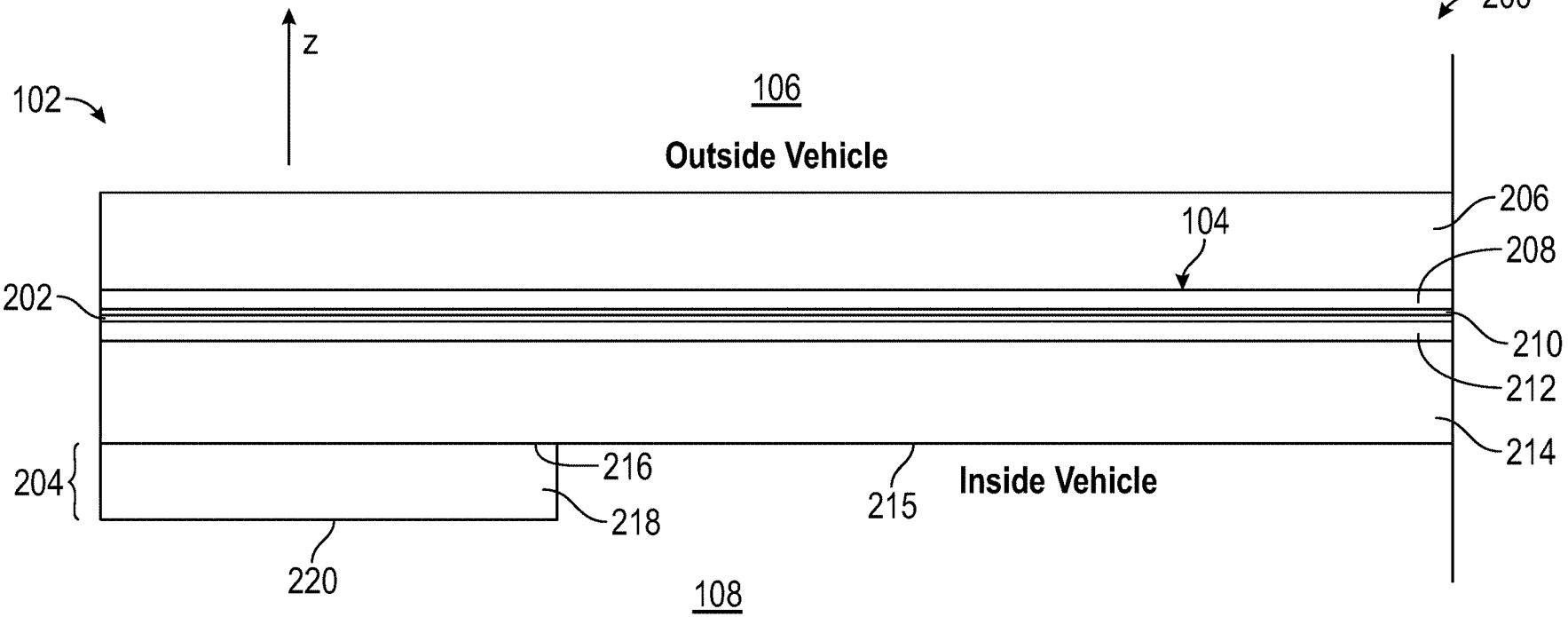
FIG. 2 shows a side view cross section of a windshield of the vehicle including a multiband antenna therein.

FIG. 2 shows a side view 200 of the windshield 102 of the vehicle 100 including a multiband antenna therein. The antenna assembly 104 includes an antenna 202 and a signal coupler 204. The antenna 202 can be a thin-film antenna and is disposed within layers of the windshield 102 or otherwise embedded within the windshield. The signal coupler 204 is located in the inner region 108 and is placed against an inside face 215 of the windshield 102. The signal coupler 204 communicates with the antenna 202 through intervening layers of the windshield 102 via electromagnetic coupling. The z-axis of the antenna assembly is shown in FIG. 2 pointing into the outer region 106.

The windshield 102 includes a plurality of layers. Moving from outer region 106 toward the inner region 108, the windshield 102 includes a first glass layer 206, a first polyvinyl butyral (PVB) layer 208, a polyethylene tetraphthalate (PET) layer 210, the antenna 202, a second PVB layer 212, and a second glass layer 214. The first PVB layer 208 and the second PVB layer 212 are adhesive layers.

The signal coupler 204 is attached or coupled to an inside face 215 of the second glass layer 214. Moving from the inside face 215 into the inner region 108, the signal coupler 204 includes a conductive slot layer 216, a dielectric layer 218 and a microstrip line layer 220. The conductive slot layer 216 can have a thin copper film having a slot formed therethrough. The microstrip line layer 220 can include a microstrip that provides a wired connection to the communication device 110. The microstrip can be made of a conductive material, such as copper. In a first embodiment, the dielectric layer 218 is constructed of a TMM4® material made by Rogers Corporation. In a second embodiment, the dielectric layer 218 is constructed of R04350 ® material made by Rogers Corporation, with all of the remaining materials the same as the first embodiment.

Figure 3:
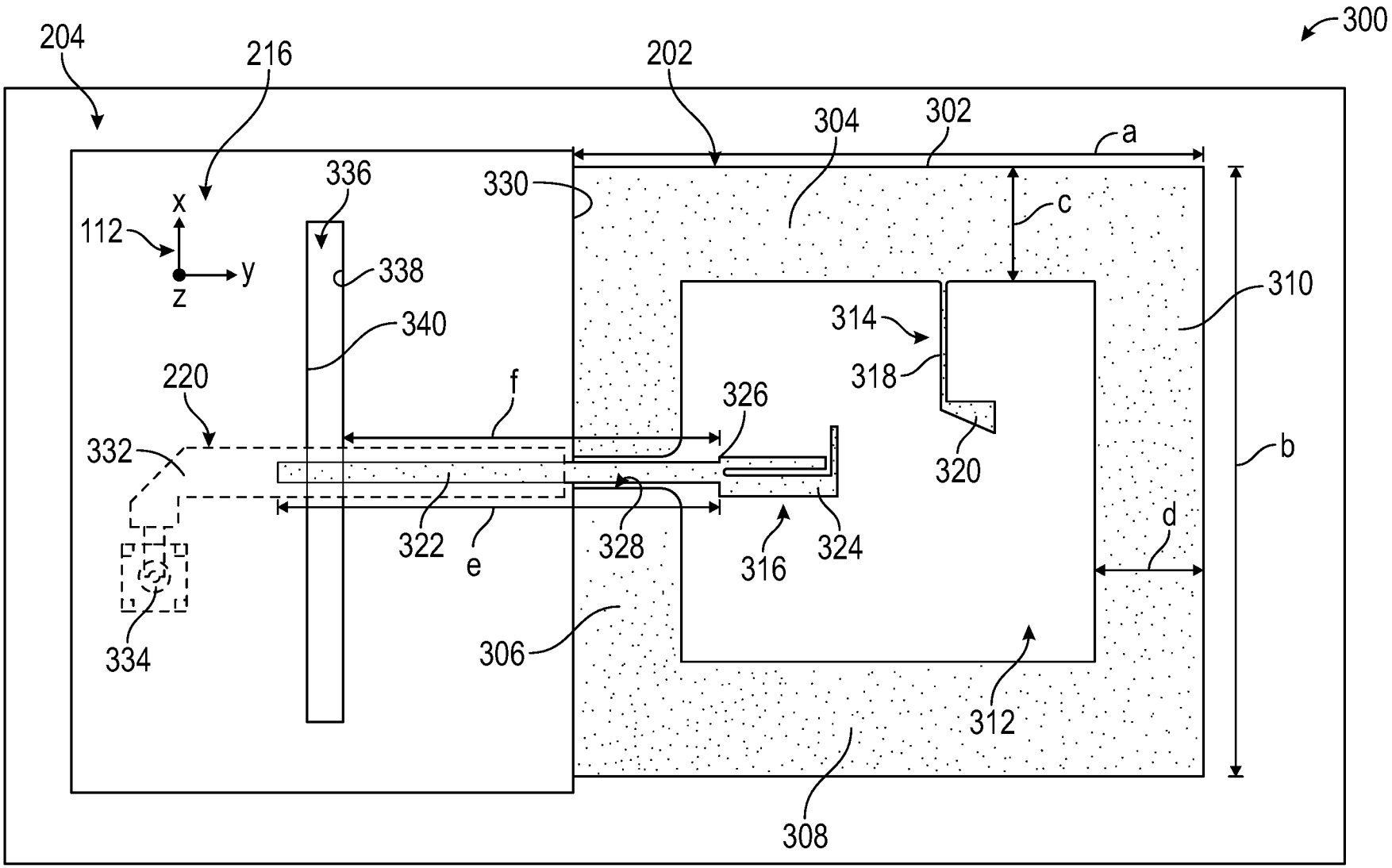
FIG. 3 shows a top view of an antenna assembly looking into a plane of the windshield from an outer region.

FIG. 3 shows a plan view 300 of the antenna assembly 104 as viewed from the outer region 106 looking into the plane of the windshield 102. The coordinate system 112 is shown to illustrate an orientation of the antenna 202 and its components with respect to the x-axis and y-axis.

The antenna 202 includes an electrically conductive loop 302. In an embodiment, the electrically conductive loop 302 is in the shape of a rectangle. A first side 304 of the rectangle extends along the y-axis, a second side 306 extends along the x-axis, a third side 308 extends along the y-axis, and a fourth side 310 extends along the x-axis. The second side 306 is adjacent the first side 304 counterclockwise from the first side as viewed from the plan view 300. The third side 308 has the same relation to the second side 306, and the fourth side 310 has the same relation to the third side 308. In an embodiment, the first side 304 and the third side 308 have a length "a" of 62.70 mm and a width "c" of 11.38 mm. The second side 306 and the fourth side 310 have a length "b" of 60.64 mm and a width "d" of 10.73 mm.

The sides of the rectangle form an interior region 312 within the x-y plane that is an empty space. A first stub 314 and a second stub 316 extend into the interior region 312 to accomplish communication over the first frequency band and the second frequency band. The first stub 314 includes a first arm 318 extending into the interior region 312 from the first side 304 and a first plate 320 at an end of the first arm 318. The first plate 320 extends from the first arm 318 toward the fourth side 310 of the rectangle. The second side 306 of the rectangle includes a gap 328 at its midpoint. The second stub 316 extends through gap 328. The second stub 316 includes a second plate 324 disposed within the interior region 312 and a second arm 322 that passes from the interior region 312 through the gap 328 to couple inductively to the signal coupler 204. The second arm 322 couples to the second plate 324 at a base 326 of the second plate.

The first stub 314 and the second stub 316 are designed to transmit and receive an elliptically polarized signal over the first frequency band and the second frequency band. In one embodiment, the signal is a circularly polarized signal. In another embodiment, the signal is a right hand circularly polarized signal.

The signal coupler 204 is located to a side of the electrically conductive loop 302. An antenna side 330 of the signal coupler 204 is adjacent to or abuts the second side 306 of the electrically conductive loop 302. As seen from the plan view 300, the second arm 322 is located in front of the conductive slot layer 216 of the signal coupler 204, and the microstrip line layer 220 (in dashed lines) is behind the conductive slot layer 216. A microstrip 332 within the microstrip line layer 220 is shown behind the conductive slot layer 216. The microstrip 332 includes a connector 334 at one end for connecting to the communication device 110. The conductive slot layer 216 includes a slot 336 therethrough. The slot 336 extends along the x-axis. The second arm 322 extends along the y-axis and thus is perpendicular to slot 336. The microstrip 332 extends along the y-axis and is parallel to the second arm 322 and overlaps a section of the second arm 322. The slot 336 has a near slot edge 338 proximate the antenna side 330 and a far slot edge 340 distal from the antenna side 330.

Figure 4:
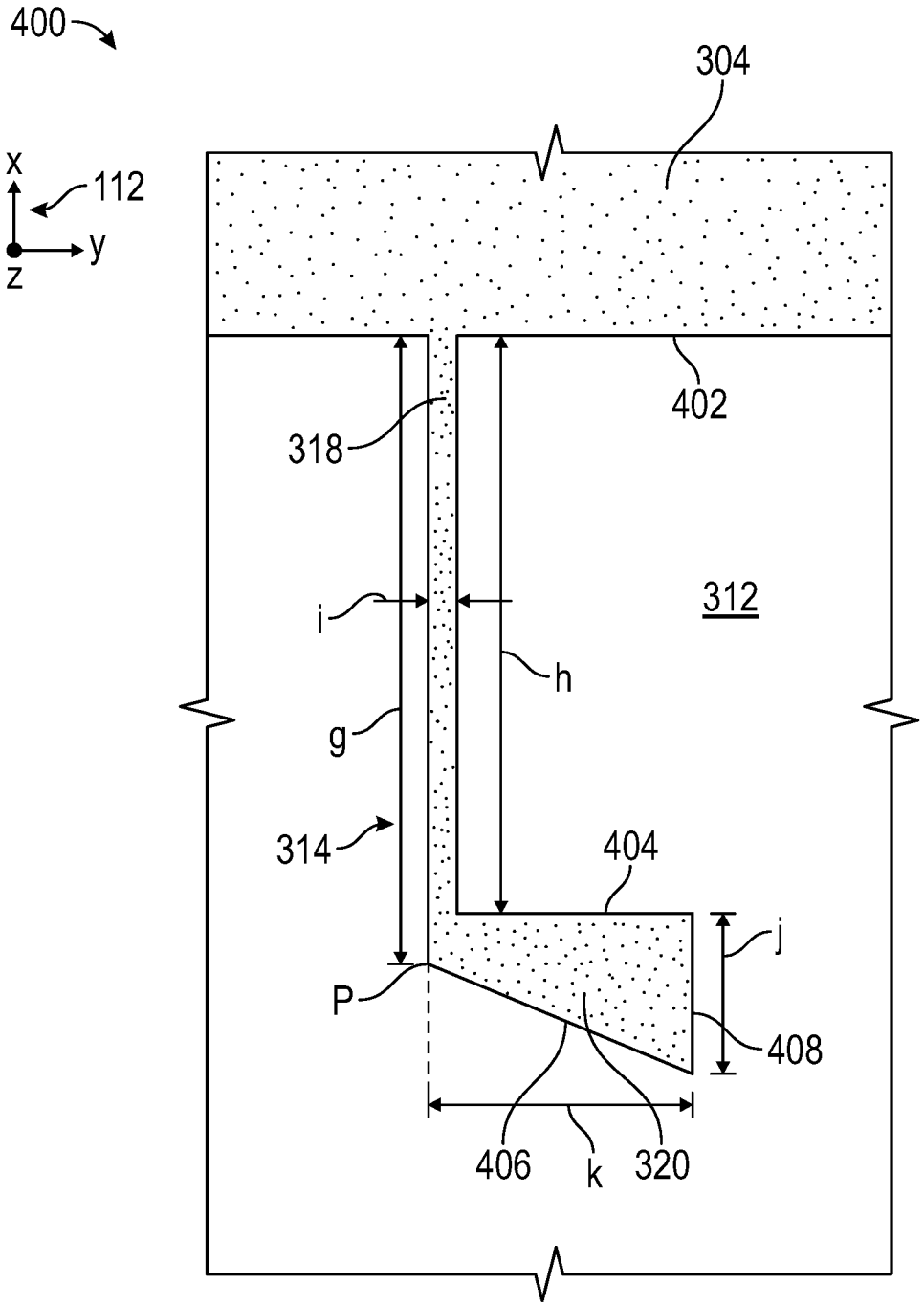
FIG. 4 shows a close-up view of a first stub of the antenna.

FIG. 4 shows a close-up view 400 of the first stub 314. The first arm 318 extends from an interior edge 402 of the first side 304 into the interior region 312 along the x-axis. The first plate 320 includes at least three sides: an inner plate edge 404, an outer plate edge 406 and an end plate edge 408. The inner plate edge 404 extends perpendicular to the first arm 318 along the y-axis to meet the end plate edge 408 at a right angle. The outer plate edge 406 extends from the first arm 318 to the end plate edge 408 at a non-zero angle to the y-axis, the non-zero angle causing the distance between the inner plate edge 404 and the outer plate edge 406 to increase with distance from the first arm 318. The outer plate edge 406 intersects the first arm at a point P.

An inner first arm length "h" is a distance between the interior edge 402 and the inner plate edge 404. An outer first arm length "g" is a distance between the interior edge 402 and the point P. In various embodiments, the inner first arm "h" length is 11.91 millimeters (mm) and the outer first arm length "g" is 12.91 mm. The width "i" of the first arm is 0.58 mm. The length "j" of the end plate edge 408 is 3.28 mm and the length "k" of the outer plate edge 406 (along the y-axis) is 4.87 mm.

Figure 5:
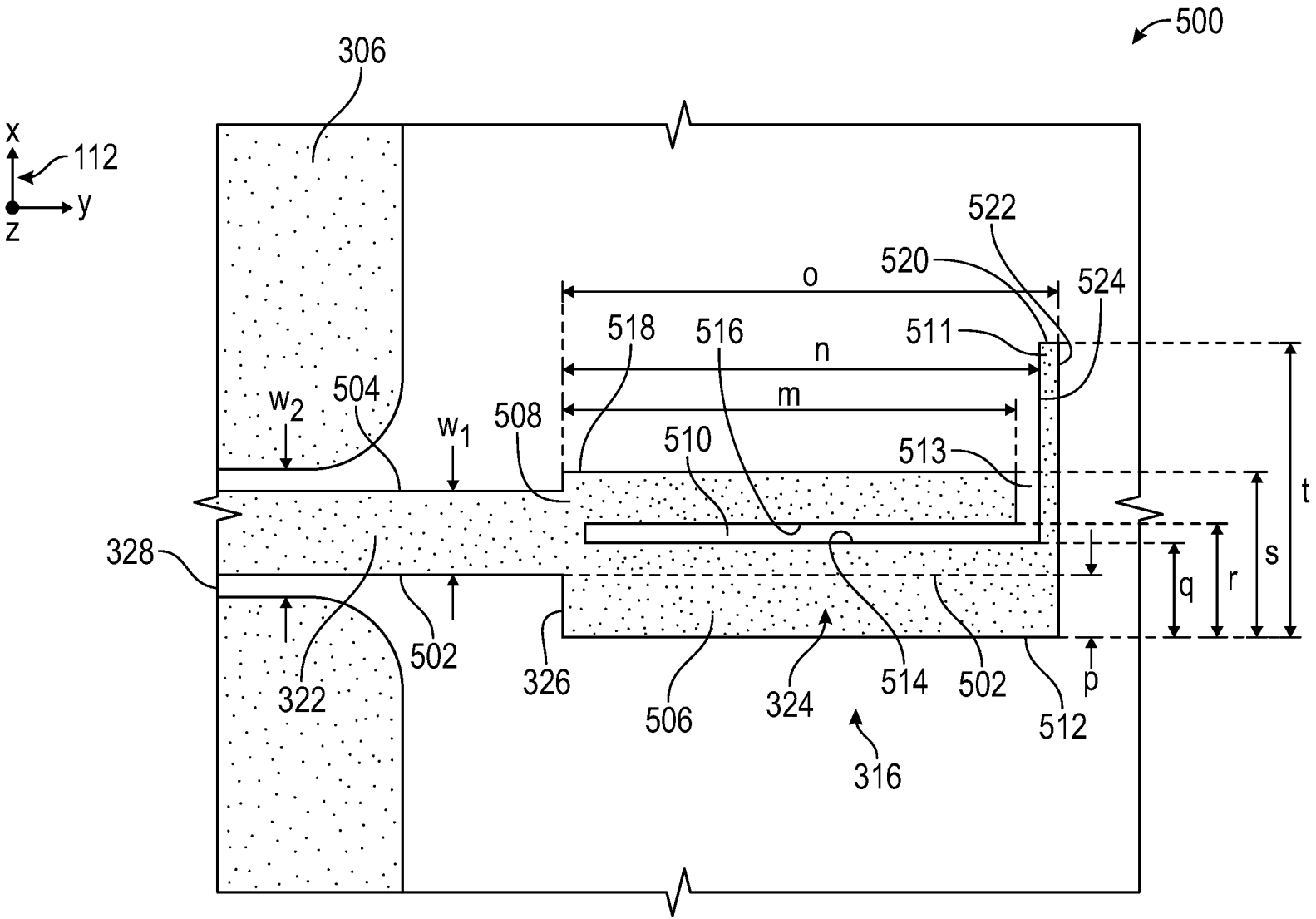
FIG. 5 shows a close-up view of a second stub of the antenna.

FIG. 5 shows a close-up view 500 of the second plate 324 of the second stub 316. The second arm 322 extends from the second plate 324 through gap 328 in second side 306. A width "w1" of the second arm 322 is defined between a first arm side 502 and a second arm side 504. In various embodiments, a width "w2" of the gap 328 is 3.00 mm, and a width of the second arm 322 is 2.23 mm.

The second arm 322 intersects the second plate 324 at a base 326. The second plate 324 includes a first prong 506 and a second prong 508, both of which extend from the base 326 along the y-axis. The first prong 506 and second prong 508 are separated along the x-axis by a prong gap 510. An extension section 511 extends along the x-axis from an end of the first prong 506. The extension section 511 is separated from the second prong 508 by an extension gap 513.

Along the x-axis, the first prong 506 has a first prong outer edge 512 and a first prong inner edge 514. The second prong 508 has second prong inner edge 516 and a second prong outer edge 518. The extension section 511 includes an extension edge 520 distal from the first prong 506. In an embodiment, a distance "p" from the first prong outer edge 512 to the first arm side 502 is 1.41 mm. A distance "q" from the first prong outer edge 512 to the first prong inner edge 514 is 2.16 mm. A distance "r" from the first prong outer edge 512 to the second prong inner edge 516 is 2.66 mm. A distance "s" from the first prong outer edge 512 to the second prong outer edge 518 is 3.86 mm. A distance "t" from the first prong outer edge 512 to the extension edge 520 is 6.90 mm.

Sides of the extension section 511 define an outer prong end 522 and an inner prong end 524. The first prong 506 extends along the y-axis from the base 326 to the outer prong end 522. An outside length "o" of the first prong 506 is measured from the base 326 to the outer prong end 522. An inner length "n" of the first prong 506 is measured from the base 326 to the inner prong end 524. In an embodiment, the outside length "o" of the first prong 506 is 11.69 mm, and the inside length "n" of the first prong 506 is 11.19 mm. A length "m" of the second prong 508 is 10.69 mm.

Returning briefly to FIG. 3, in an embodiment, a length "e" of the second arm 322 is 44 mm. A distance "f" between the base 326 and the near slot edge 338 of the slot 336 is 24.82 mm.

Figure 6:
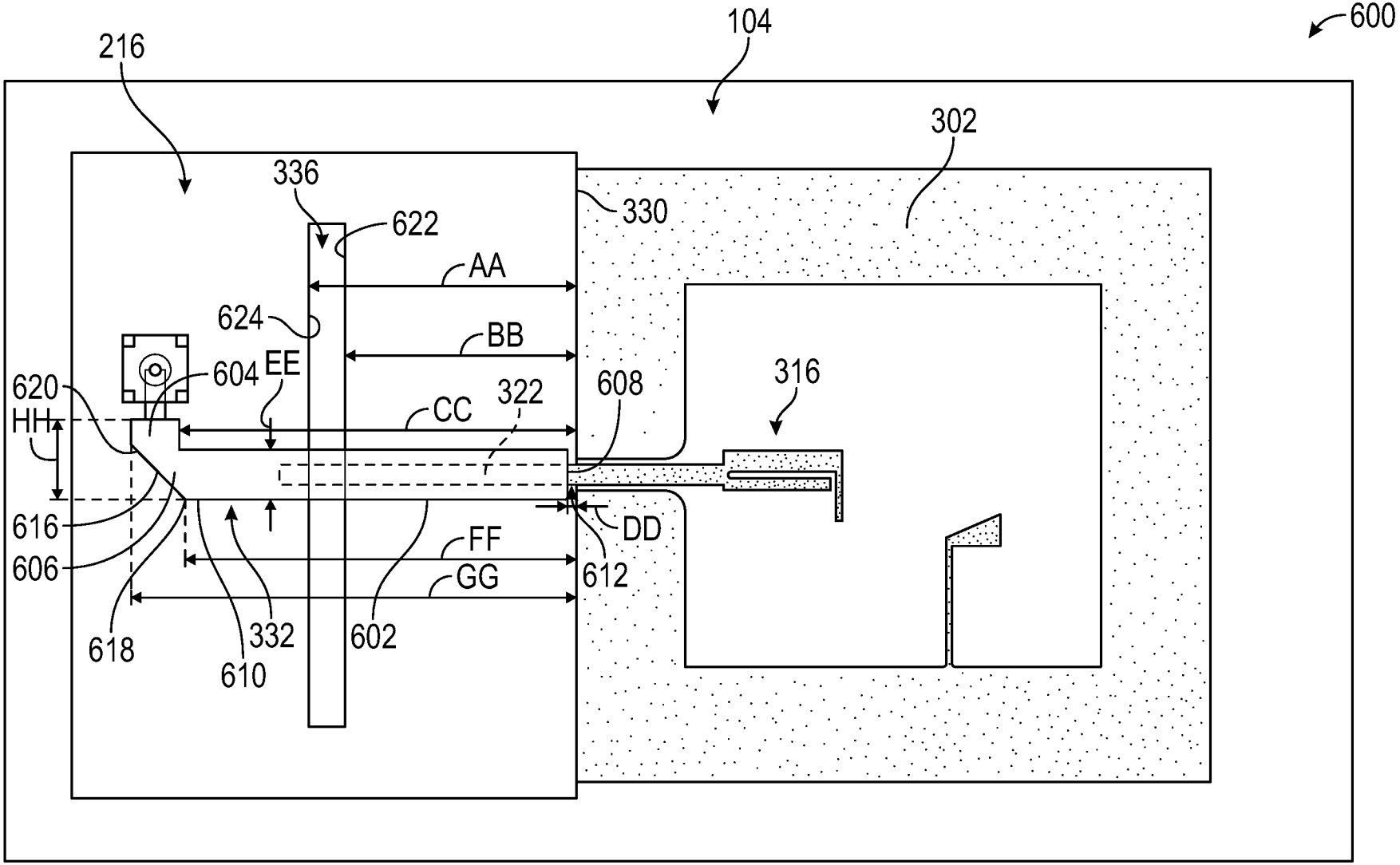
FIG. 6 shows a bottom view of the antenna assembly of FIG. 3.

FIG. 6 shows a bottom view 600 of the antenna assembly 104. As shown in the bottom view 600, the microstrip 332 is in the foreground in front of the conductive slot layer 216. The second arm 322 of the second stub 316 is shown in the background behind the conductive slot layer 216. The microstrip 332 is a single strip that includes a transmission line 602 and a connector 604. The transmission line 602 extends from a near end 608 proximate the antenna side 330 of the conductive slot layer 216 to a far end 610 distal from the antenna side 330. The near end 608 is separated from antenna side 330 by a gap 612 and extends perpendicularly away from the electrically conductive loop 302.

At the far end 610, the connector 604 forms a right angle to the transmission line 602. An angled section 606 between the connector 604 and transmission line 602 includes an angled edge 616 that intersects the transmission line 602 at a first vertex 618 and intersects the connector 604 at a second vertex 620.

The distance (BB) between antenna side 330 and the near slot edge 622 is 22.97 mm. The distance (AA) between antenna side 330 and the far slot edge 624 is 26.54 mm. The distance (CC) from the antenna side 330 to the near side of the connector 604 is 39.39 mm. The length (DD) of gap 612 is 0.99 mm. The width (EE) of the transmission line 602 is 4.80 mm. The distance (FF) from the antenna side 630 to the first vertex 618 is 38.69 mm. The distance (GG) from the antenna side 330 to the second vertex 620 is 44.19. The length (HH) of the connector 604 is 7.86 mm.

Figure 7:
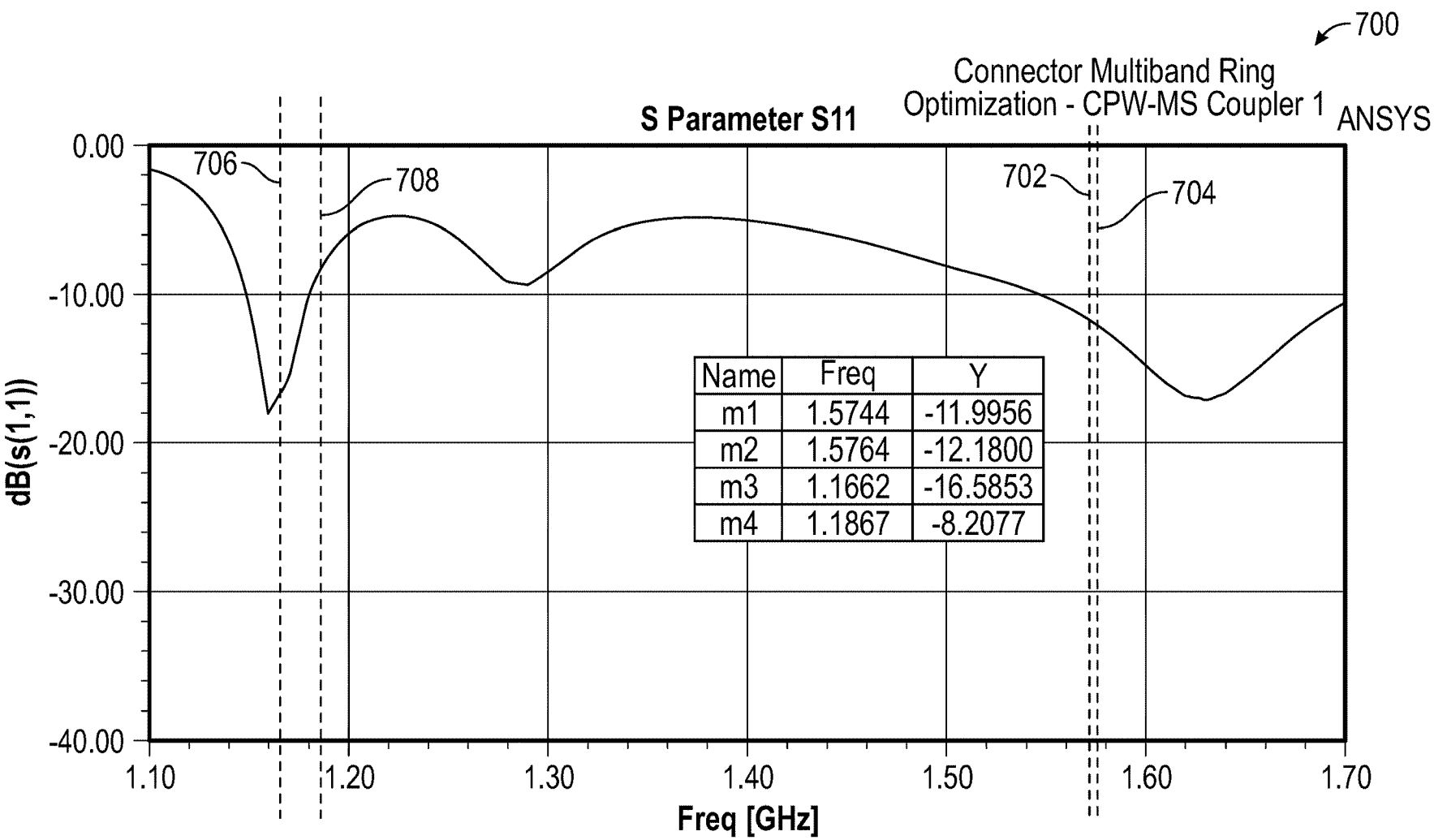
FIG. 7 shows a relation between reflection coefficient and signal frequency for a first embodiment of the antenna.

FIG. 7 shows a relation 700 between reflection coefficient and signal frequency for the first embodiment (i.e., in which the dielectric layer 218 constructed of TMM4®). Frequency is shown along the abscissa in GigaHertz (GHz) and reflection coefficient S11 is shown along the ordinate axis in decibels (dB). Frequency line 702 marks a low frequency limit for the L1 band and frequency line 704 marks a high frequency limit for the L1 band. Frequency line 706 marks a low frequency limit for the L5 band, and frequency line 708 marks the high frequency limit for the L5 band. The relations 700 indicates that the antenna is reasonably well matched to efficiently operate at both L1 and L5 GNSS frequency bands.

Figure 8:
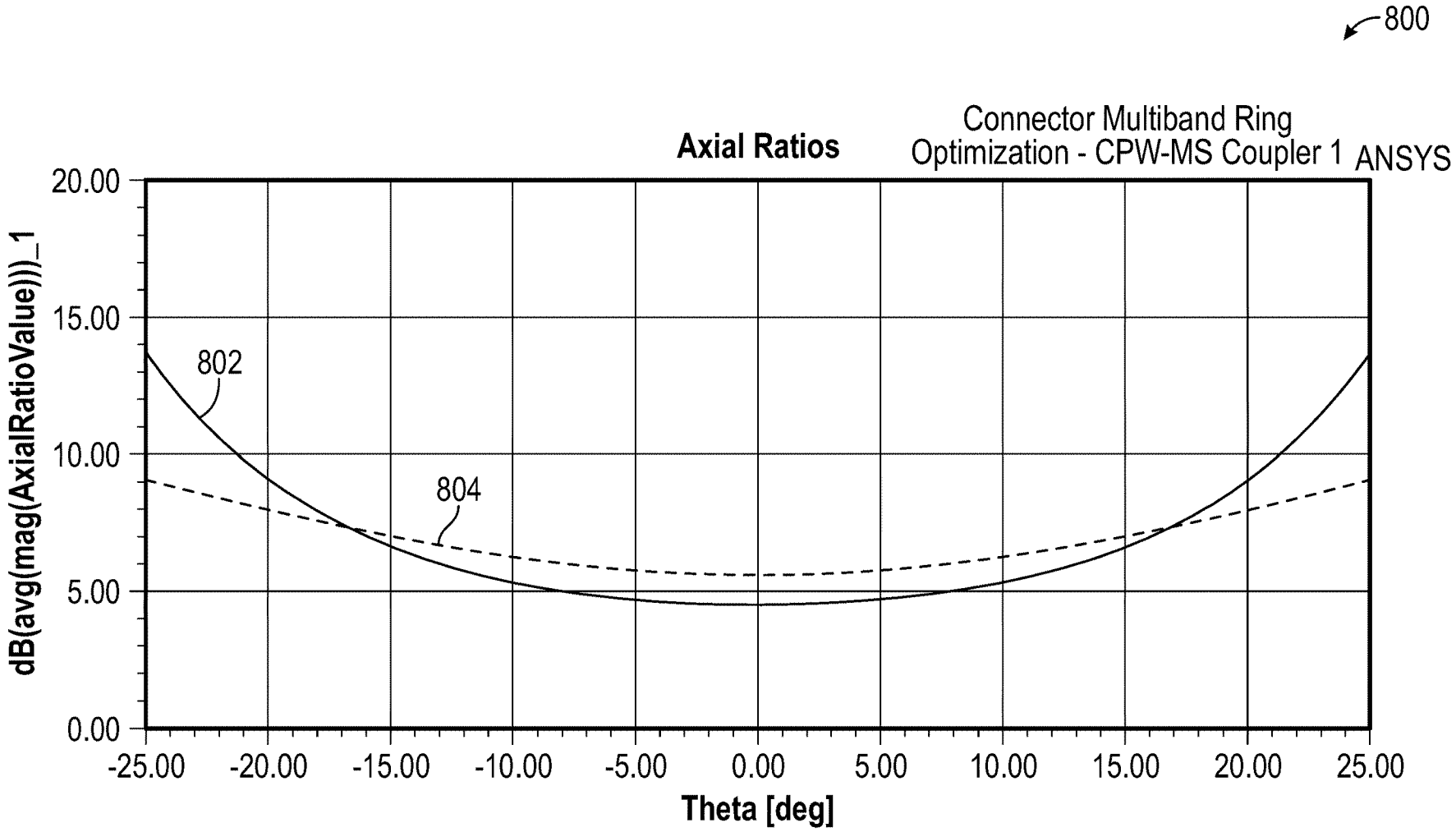
FIG. 8 shows a relation between axial ratio of a signal and an angle measured from the y-z plane for the first embodiment.

FIG. 8 shows a relation 800 between axial ratio of a signal and an angle θ measured from the y-z plane for the first embodiment. The angle θ is shown along the abscissa in degrees and the axial ratio is shown along the ordinate axis in decibels (dB). The axial ratio is a measure of an antenna's capability of measuring the circularly polarized signal. The axial ratio measure a difference in intensities of a signal along two perpendicular axes of an elliptically polarized signal. For a circularly polarized signal the intensity along each axis is the same. Therefore, their ratio is 1 and the decibel level of the axial ratio is zero. Curve 802 shows the relation of axial ratio to angle θ for a signal in the L1 band. Curve 804 shows the relation of axial ratio to angle θ for a signal in the L5 band. Curves 802 and 804 show that the antenna's polarization deviates from circular polarization at various angles. Thus, the antenna is more sensitive or receptive to a circularly polarized signal received from some angles than from others. Different axial ratio curves can be obtained using different configurations of the antenna disclosed herein.

Figure 9:
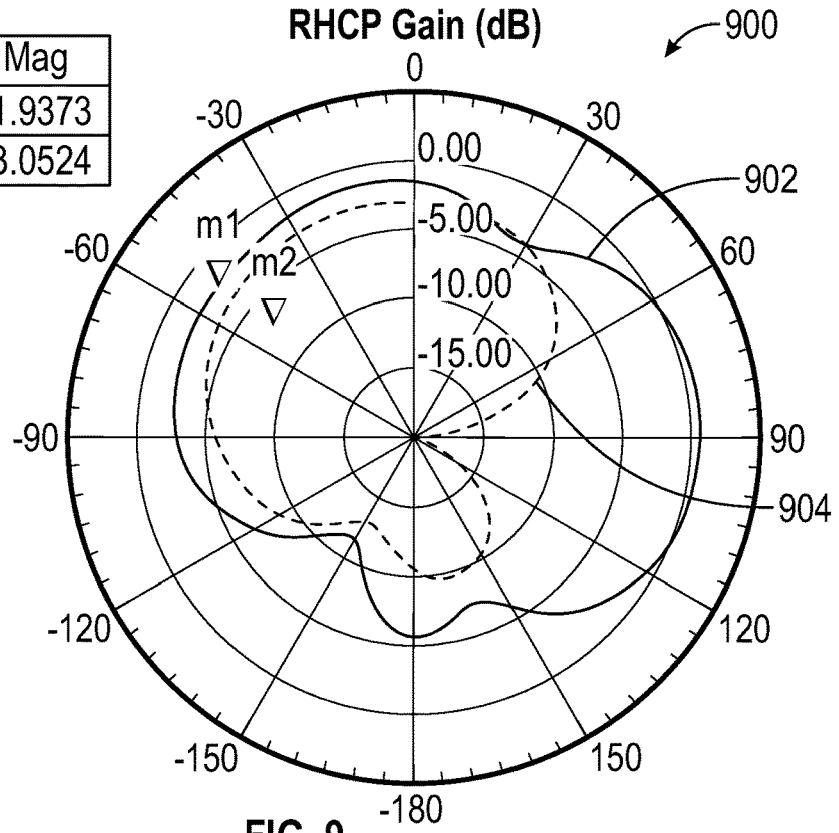
FIG. 9 shows an antenna gain pattern for the central frequencies of the L1 and L5 bands over an angular range within the y-z plane of the coordinate system (i.e., from front to back of the vehicle), for the first embodiment.

FIG. 9 shows an antenna gain pattern 900 for the central frequencies of the L1 and L5 bands over an angular range within the y-z plane of the coordinate system (i.e., from front to back of the vehicle), for the first embodiment. Angle is shown around the circumference in degrees, and gain is shown along the radius of the chart. Curve 902 shows the gain pattern for the L1 band. Curve 904 shows the gain pattern for the L5 band.

Figure 10:
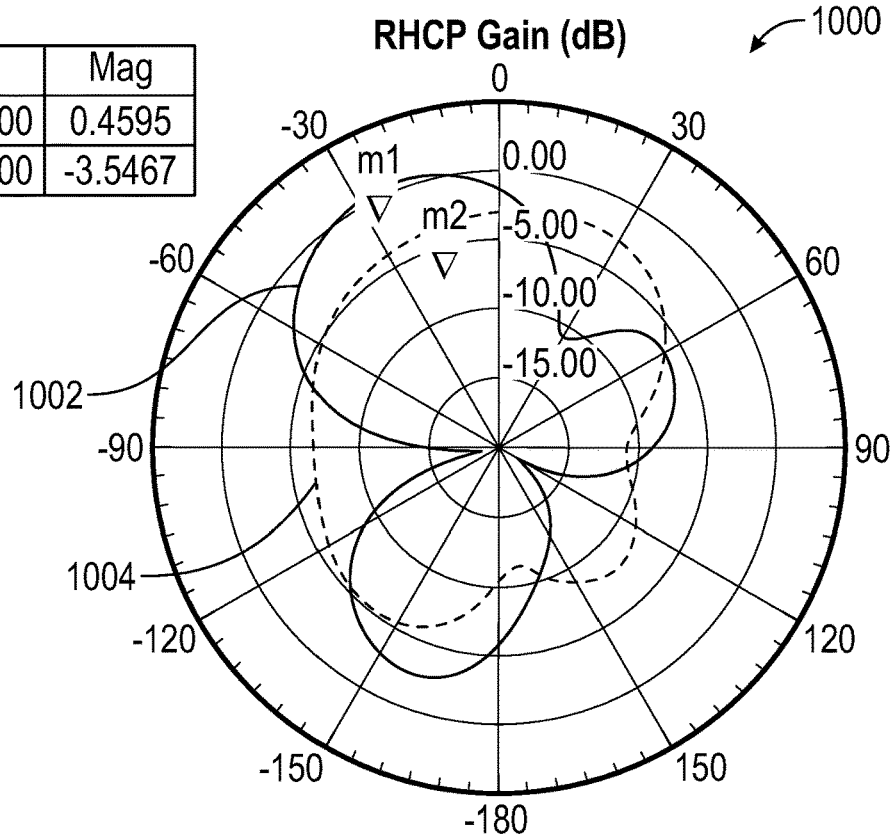
FIG. 10 shows an antenna gain pattern for the central frequencies of the L1 and L5 bands over an angular range within the x-z plane of the coordinate system (i.e., from side to side of the vehicle), for the first embodiment.

FIG. 10 shows an antenna gain pattern 1000 for the central frequencies of the L1 and L5 bands over an angular range within the x-z plane of the coordinate system (i.e., from side to side of the vehicle), for the first embodiment. Angle is shown around the circumference in degrees. Gain is shown along the radius of the chart. Curve 1002 shows the gain pattern for the L1 band. Curve 1004 shows the gain pattern for the L5 band.

Figure 11:
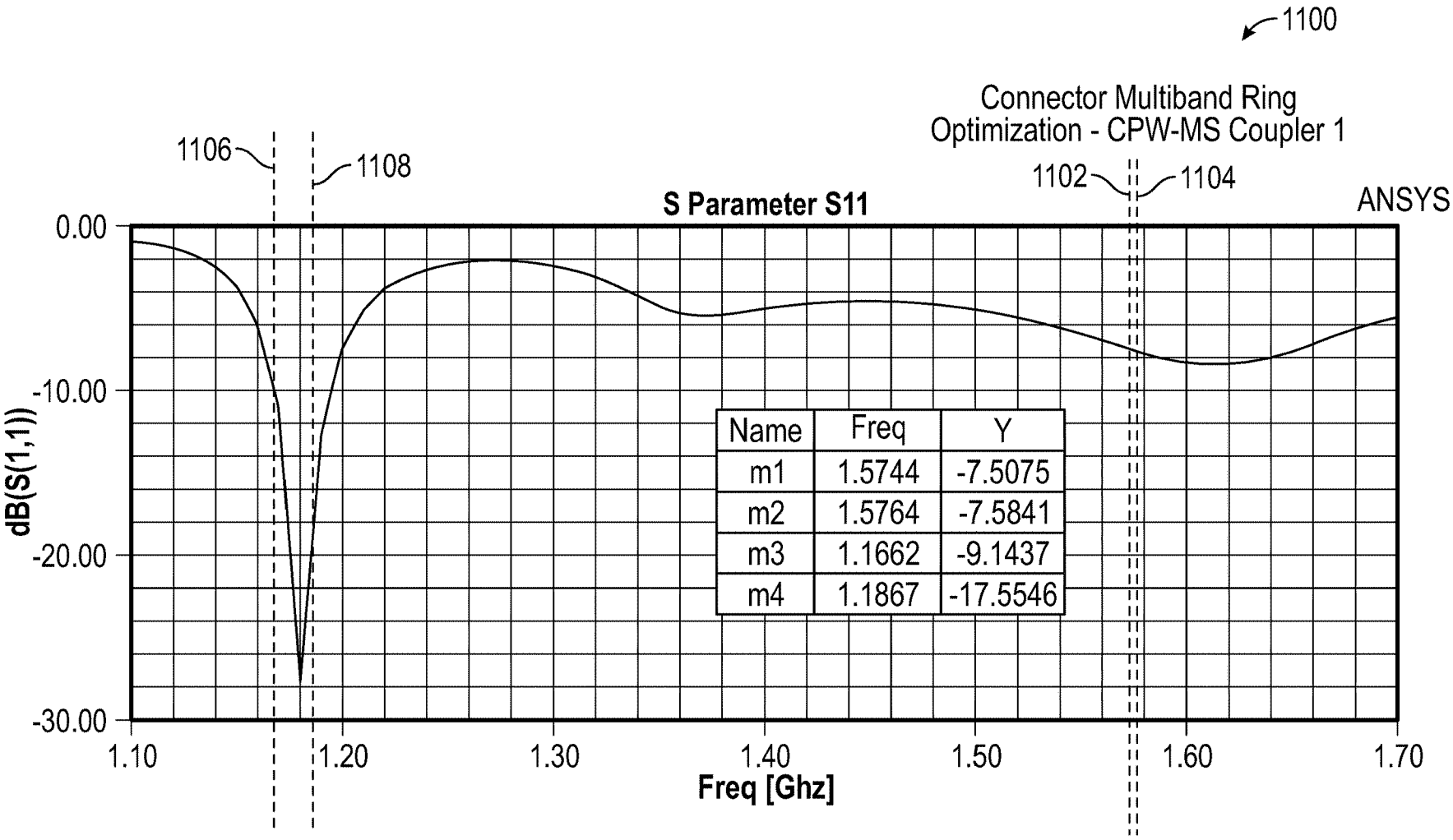
FIG. 11 shows a relation of reflection coefficient and frequency for a second embodiment of the antenna.

FIG. 11 shows a relation of reflection coefficient and frequency for the second embodiment (i.e., in which the dielectric layer 218 constructed of R04350®). Frequency is shown along the abscissa in GigaHertz (GHz) and reflection coefficient S11 is shown along the ordinate axis in decibels (dB). Frequency line 1102 marking a low frequency limit for the L1 band and frequency line 1104 marks a high frequency limit for the L5 band. Frequency line 1106 marks a low frequency limit for the L5 band, and frequency line 1108 marks the high frequency limit for the L5 band.

Figure 12:
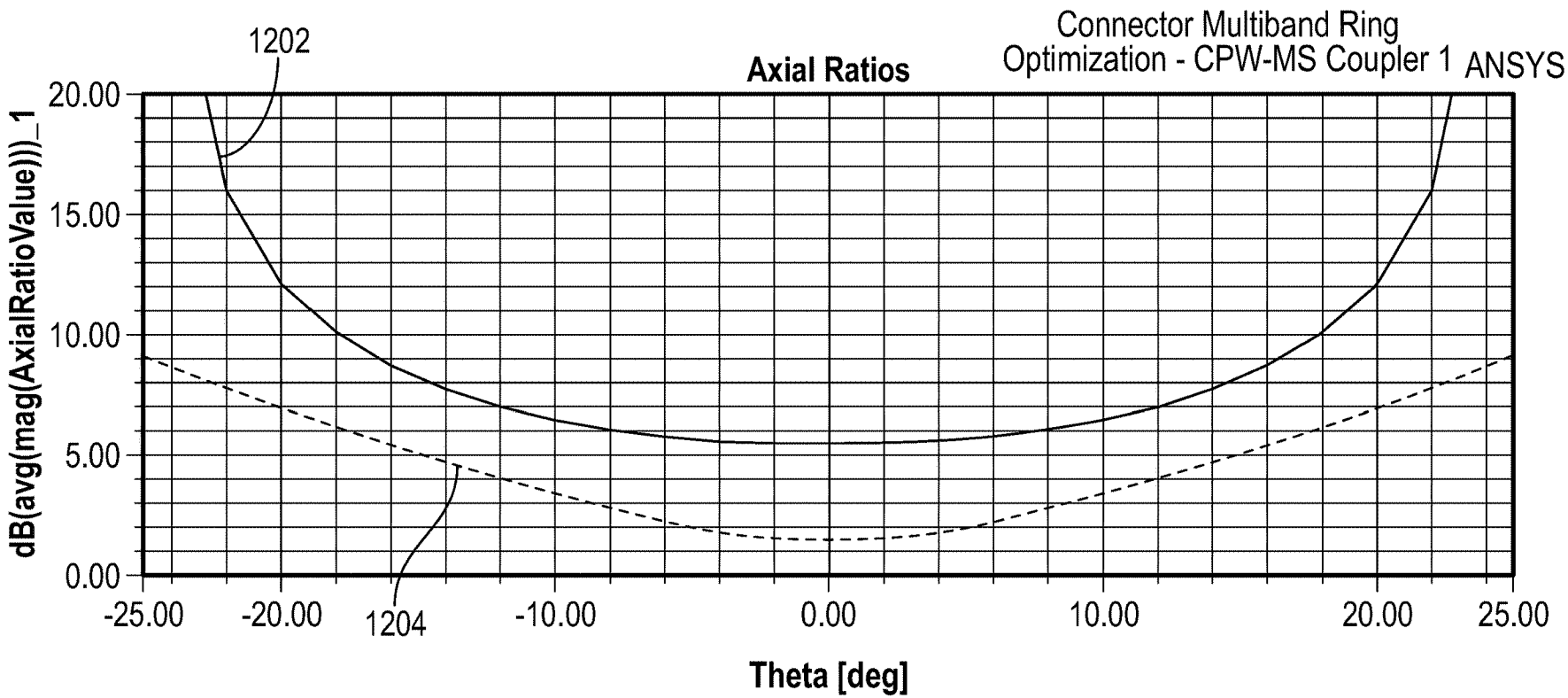
FIG. 12 shows a relation of axial ratio to an angle measured from the y-z plane for the second embodiment.

FIG. 12 shows a relation 1200 of axial ratio to an angle θ is measured from the y-z plane for the second embodiment. The angle θ is shown along the abscissa in degrees and the axial ratio is shown along the ordinate axis in decibels (dB). Curve 1202 shows the relation of axial ratio to angle θ for a signal in the L1 band. Curve 1204 shows the relation of axial ratio to angle θ for a signal in the L5 band.

Figure 13:
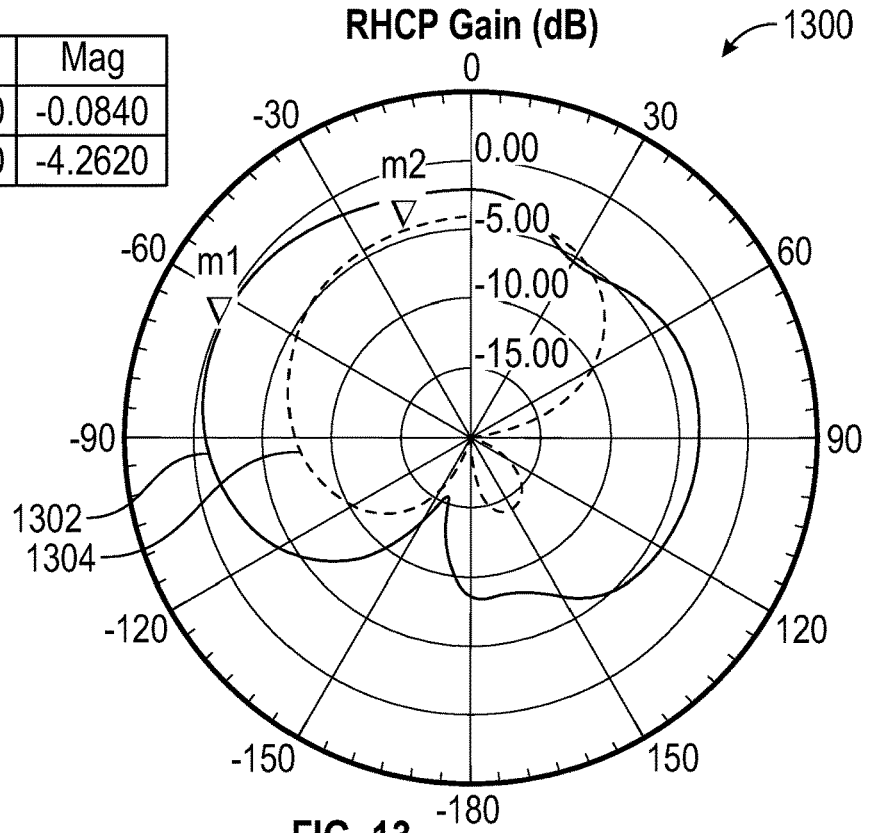
FIG. 13 shows an antenna gain pattern for the central frequencies of the L1 and L5 bands over an angular range within the y-z plane of the coordinate system (i.e., from front to back of the vehicle), for the second embodiment.

FIG. 13 shows an antenna gain pattern 1300 for the central frequencies of the L1 and L5 bands over an angular range within the y-z plane of the coordinate system (i.e., from front to back of the vehicle), for the second embodiment. Angle is shown around the circumference in degrees. Gain is shown along the radius of the chart. Curve 1302 shows the gain pattern for the L1 band. Curve 1304 shows the gain pattern for the L5 band.

Figure 14:
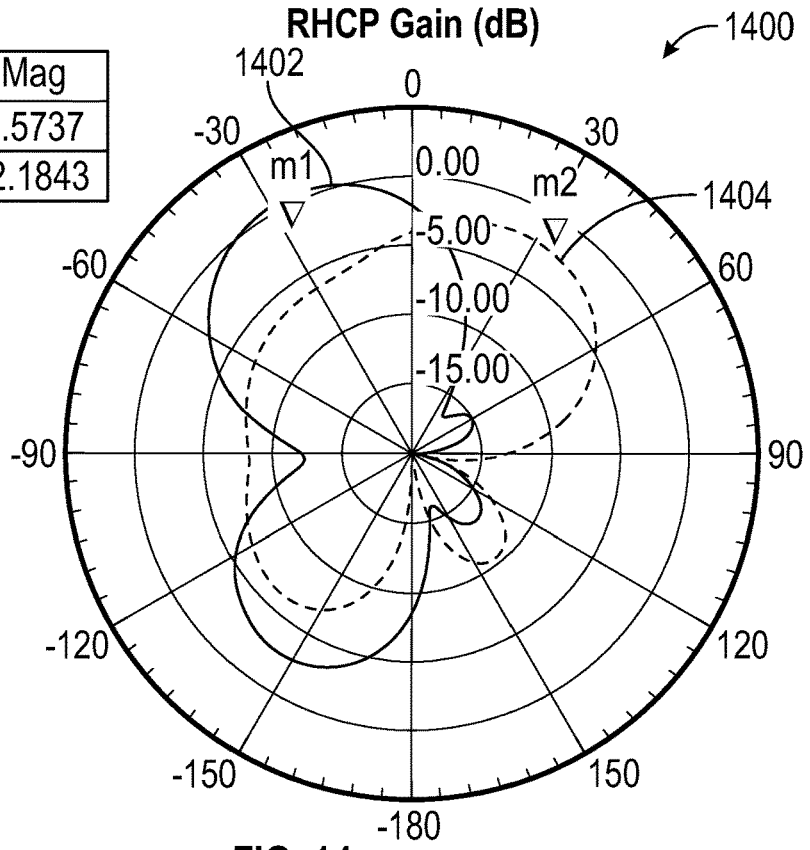
FIG. 14 shows an antenna gain pattern for the central frequencies of the L1 and L5 bands over an angular range within the x-z plane of the coordinate system (i.e., from side to side of the vehicle), for the second embodiment.

FIG. 14 shows an antenna gain pattern 1400 for the central frequencies of the L1 and L5 bands over an angular range within the x-z plane of the coordinate system (i.e., from side to side of the vehicle), for the second embodiment. Angle is shown around the circumference in degrees. Gain is shown along the radius of the chart. Curve 1402 shows the gain pattern for the L1 band. Curve 1404 shows the gain pattern for the L5 band.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. An antenna assembly for a vehicle, comprising:

an antenna configured to receive signals over a first frequency band and a second frequency band separated from the first frequency band, wherein the antenna is embedded within a windshield of the vehicle, wherein the antenna is in a shape of a rectangle with an interior region and a first stub and a second stub extending into the interior region, the first stub including a first plate disposed at an end of a first arm and the second stub including a second plate disposed at an end of a second arm, the second plate including a first prong extending parallel to the second arm and a second prong extending parallel to the second arm and separated from the first prong by a prong gap; and a signal coupler that electromagnetically couples to the antenna through the windshield.

2. The antenna assembly of claim 1, wherein the first frequency band is an L1 frequency band and the second frequency band is an L5 frequency band.

3. The antenna assembly of claim 1, wherein the first stub and the second stub are configured for receiving a circularly polarized signal within both of the first band and the second band.

4. The antenna assembly of claim 3, wherein the first stub extends into the interior region from a first side of the rectangle and the second stub passes through a gap in a second side of the rectangle adjacent the first side.

5. The antenna assembly of claim 3, wherein the the first prong includes an extension separated from the second prong by an extension gap.

6. The antenna assembly of claim 1, wherein the signal coupler further comprises a transmission line and a conductive slot layer disposed between the transmission line and the windshield, the conductive slot layer including a slot perpendicular to the transmission line.

7. The antenna assembly of claim 6, wherein the second stub extends parallel to the transmission line and overlaps the transmission line at the slot.

8. A windshield, comprising, an antenna configured to receive signals over a first frequency band and a second frequency band separated from the first frequency band, wherein the antenna is embedded within the windshield, wherein the antenna is in a shape of a rectangle with an interior region and a first stub and a second stub extending into the interior region, the first stub including a first plate disposed at an end of a first arm and the second stub including a second plate disposed at an end of a second arm, the second plate including a first prong extending parallel to the second arm and a second prong extending parallel to the second arm and separated from the first prong by a prong gap; and a signal coupler that electromagnetically couples to the antenna through the windshield.

9. The windshield of claim 8, wherein the first frequency band is an L1 frequency band and the second frequency band is an L5 frequency band.

10. The windshield of claim 8, wherein the first stub and the second stub are configured for receiving a circularly polarized signal within both of the first band and the second band.

11. The windshield of claim 10, wherein the first stub extends into the interior region from a first side of the rectangle and the second stub passes through a gap in a second side of the rectangle adjacent the first side.

12. The windshield of claim 10, wherein the first prong includes an extension separated from the second prong by an extension gap.

13. The windshield of claim 8, wherein the signal coupler further comprises a transmission line and a conductive slot layer disposed between the transmission line and the windshield, the conductive slot layer including a slot perpendicular to the transmission line.

14. The windshield of claim 13, wherein the second stub extends parallel to the transmission line and overlaps the transmission line at the slot.

15. A vehicle, comprising, an antenna configured to receive signals over a first frequency band and a second frequency band separated from the first frequency band, wherein the antenna is embedded within a windshield of the vehicle, wherein the antenna is in a shape of a rectangle with an interior region and a first stub and a second stub extending into the interior region, the first stub including a first plate disposed at an end of a first arm and the second stub including a second plate disposed at an end of a second arm, the second plate including a first prong extending parallel to the second arm and a second prong extending parallel to the second arm and separated from the first prong by a prong gap; and a signal coupler that electromagnetically couples to the antenna through the windshield.

16. The vehicle of claim 15, wherein the first frequency band is an L1 frequency band and the second frequency band is an L5 frequency band.

17. The vehicle of claim 15, wherein the first stub and the second stub are configured for receiving a circularly polarized signal within both of the first band and the second band.

18. The vehicle of claim 17, wherein the first stub extends into the interior region from a first side of the rectangle and the second stub passes through a gap in a second side of the rectangle adjacent the first side.

19. The vehicle of claim 17, wherein the first prong includes an extension separated from the second prong by an extension gap.

20. The vehicle of claim 15, wherein the signal coupler further comprises a transmission line and a conductive slot layer disposed between the transmission line and the windshield, the conductive slot layer including a slot perpendicular to the transmission line, wherein the second stub extends parallel to the transmission line and overlaps the transmission line at the slot.

* * * * *